US005262600A

United States Patent [19]

Woods

[11] Patent Number: 5,262,600

[45] Date of Patent: Nov. 16, 1993

[54] IN-LINE INSERTION MUFFLER FOR MARINE ENGINES

[76] Inventor: Woodrow E. Woods, 3640 Fiscal Ct., Riviera Beach, Fla. 33404

[21] Appl. No.: 785,687

[22] Filed: Oct. 31, 1991

[51] Int. Cl.[5] ..... F01N 7/08; F01N 7/12

[52] U.S. Cl. ..... 181/227; 181/232; 181/235

[58] Field of Search ..... 181/227, 232, 235, 249, 181/255, 264, 269, 228

[56] References Cited

U.S. PATENT DOCUMENTS

| | | | |
|---|---|---|---|
| 4,296,832 | 10/1981 | Kicinski | 181/255 |
| 4,450,934 | 5/1984 | Davis | 181/228 |
| 4,487,289 | 12/1984 | Kicinski et al. | 181/252 |
| 4,632,216 | 12/1986 | Wagner et al. | 181/255 |

*Primary Examiner*—Michael L. Gellner

*Assistant Examiner*—Eddie C. Lee

*Attorney, Agent, or Firm*—Malin, Haley, DiMaggio & Crosby

[57] ABSTRACT

An improved muffler for silencing the exhaust emitted from a water cooled marine engine employing a first housing encompassing a second housing which is partitioned by an angularly disposed inner planar baffle further having an inlet for exhaust gas and cooling water to fluidly communicate into an inlet chamber of the second housing resulting in a diminution in flow velocity so as to attenuate the exhaust noise, the exhaust gas and cooling water exiting the inlet chamber through an aperture fluidly communicated therewith into a silencing volume formed by an area between the first and second housing and forced through an aperture into an outlet chamber of said second housing. The outlet chamber acting as a back flow preventor.

11 Claims, 4 Drawing Sheets

IN-LINE INSERTION MUFFLER FOR MARINE ENGINES

BACKGROUND OF THE INVENTION

1. Field of the Invention

This invention relates generally to a muffler for quieting the exhaust from an internal combustion marine engine, and more particularly, to an in-line muffler which can replace, or be inserted into, a conventional marine exhaust system.

2. Description of the Prior Art

The exhaust of the typical inboard marine vessel is directed through the transom. Such applications place the exhaust outlet near or below the water line leading to possible back flow situations when the exhaust gas does not present enough force to overcome a water surge, or where water enters the exhaust pipe while the engine is off. To prevent this back flow of water into the muffler or engine, a check valve or flapper valve is usually employed. However, flapper valves, having moving parts, quickly corrode and fail, leading to a potentially dangerous blockage of exhaust flow.

There are a variety of marine mufflers presently known in the art which are of the "axial flow" type such as the muffler disclosed in U.S. Pat. No. 4,167,987, issued to Turner. The Turner patent describes a multiple flow marine muffler wherein exhaust noise is attenuated by passing the exhaust gas through a series of longitudinally spaced opposing baffles. Although the device allows an in-line connection, such a configuration requires an elongated cylindrical shell to provide the required baffling effect, thus precluding application in tight-fit areas such as smaller boats or other situations where space is at a premium. The use of an axial flow muffler does not address the need to counter water surges. Also, axial flow mufflers cannot be placed below the water line without some form of surge suppression.

Another marine muffler, known as a "lift muffler," is disclosed in U.S. Pat. No. 3,296,997, issued to Hoiby, et al. The Hoiby muffler is essentially an up-right drum-shaped housing having an exhaust inlet near the top and a stand pipe exhaust outlet centrally located with its opening spaced above the drum bottom. The stand pipe directs the muffled exhaust gas and collected cooling water upwardly and outwardly to a location where it can be discharged from the boat without further back pressure. Such a device precludes application in tight-fit areas as the centrally located stand pipe requires exhaust conduit modifications to accommodate the pipe. Further, Hoiby does not present a means to prevent a reverse flow of water when the exhaust outlet is submerged.

Another type of marine muffler is disclosed in U.S. Pat. No. 4,917,640, issued to Miles. Miles teaches the use of a marine muffler wherein the engine exhaust is displaced between chambers through a series of parallel conduits transverse to the muffler body length. Cooling water from the exhaust manifold is entrapped at the bottom of the main chamber, a portion thereof remaining in the chamber, the remainder of which accompanies exhaust gas out of the muffler body. The exhaust noise is attenuated by baffling the exhaust gas through multiple chambers and in contacting the entrapped water. However, this type of muffler is not amenable to mounting within the boat hull without elaborate piping geometry so that the muffler can be fed at the top and evacuated at the bottom.

The exhaust outlet of an inboard-powered marine vessel is usually placed at or about the water line of the boat. As a result, surges of water routinely enter the exhaust outlet and travel through the exhaust system. This surge water could disable the engine if it is permitted to travel far enough, possibly leading to disastrous results, especially if the vessel is far from port.

Also, in certain applications, it is very difficult and/or costly to remove and replace a marine muffler, in some cases requiring the destructive removal of the rear deck, replacement of the muffler therebelow, and subsequent installation of new decking. No one has heretofore proposed an anti-surge in-line muffler which may be inserted into the exhaust system of an inboard marine vessel through the external exhaust opening.

Therefore, there exists a need for a muffler capable of installation within the confines of a conventional exhaust pipe wherein the exhaust inlet and outlet may be situated at the same level to permit in-line placement thereof. Further, there exists a need to prevent back flow of water into the muffler without the addition of a check or flapper valve.

SUMMARY OF THE INVENTION

The present invention provides an in-line muffler for use with internal combustion marine engines. The apparatus is generally characterized by an elongated tubular inner housing, made from steel or heat resistant fiberglass, having a planar baffle therein and a plurality of apertures which, when inserted into a conventional exhaust pipe, attenuates engine exhaust noise and further operates as a surge protector.

Alternatively, the inner housing can be placed within a larger housing and permanently attached thereto, forming a muffler assembly wherein the larger housing includes an inlet and outlet adaptable to a conventional exhaust system by flange, U-bolt, welding, or the like.

The inner housing defines an inlet aperture and an outlet aperture, and is sealingly attachable to the inner surface of an outer housing, or exhaust conduit, by the use of flaired end segments connected to the inner housing. The volume is thus formed between the end segments, bordered on the interior by the elongate body portion of the inner housing and on the outside by the inner peripheral surface of the outer housing.

The impervious planar baffle terminates in an outer periphery and is rigidly fit within the interior of the inner housing, at an angle with respect to radial planes passing normal to the elongate center axis of the inner housing, such that the interior chamber of the inner housing is partitioned into an inlet chamber and an outlet chamber.

A first, preferably elongated, flow aperture is disposed in the side wall of the inlet chamber, fluidly communicating the inlet chamber with the peripheral or silencing volume. A second elongated flow aperture is disposed within the side wall of the outlet chamber fluidly communicating the peripheral or silencing volume with the outlet chamber.

The muffler is made operational by inlet means of the outer housing permitting the influx of exhaust gas and cooling water into the inlet chamber of the inner housing thereby providing an area for attenuation of exhaust noise. Exhaust gas is forced through the aperture in the inlet chamber into the silencing volume formed between the end segments, inner wall of the outer housing and outer wall of the inner housing. The exhaust circulates in the silencing volume encompassing the outer surface of the inner housing and is forced through the aperture located in the outlet chamber. The exhaust gas and water thereafter exit through the outlet chamber and segment and continue into a conventional exhaust pipe coupled thereto.

A portion of the silencing volume may operate as a fluid collector further baffling the exhaust and dampening side wall sound reflections. The angularly disposed planar baffle acts as a reversing ramp to reverse the flow of surge water into the muffler, thereby preventing surge water from reaching the engine.

In accordance with the present invention, it is an object to provide an improved in-line muffler for use with marine engines which permits installation within a minimal space in the boat hull.

It is an additional object of the instant invention to provide an improved in-line muffler which allows placement of the inlet and outlet exhaust passageways colinearly, thus allowing lower placement of the exhaust outlet relative to the water line without additional piping or back pressure.

It is still another object of the instant invention to provide an in-line, anti-surge marine muffler.

It is yet still another object of the instant invention to provide a break in the exhaust flow path of an in-line muffler, effectively operating as a surge protector.

Still another object of the instant invention is to provide a low cost replacement muffler that can be used with conventional or existing exhaust pipe.

In accordance with these and other objects which will become apparent hereinafter, the instant invention will now be described with particular reference to the accompanying drawings.

DETAILED DESCRIPTION OF THE PREFERRED EMBODIMENT

Figure 1:
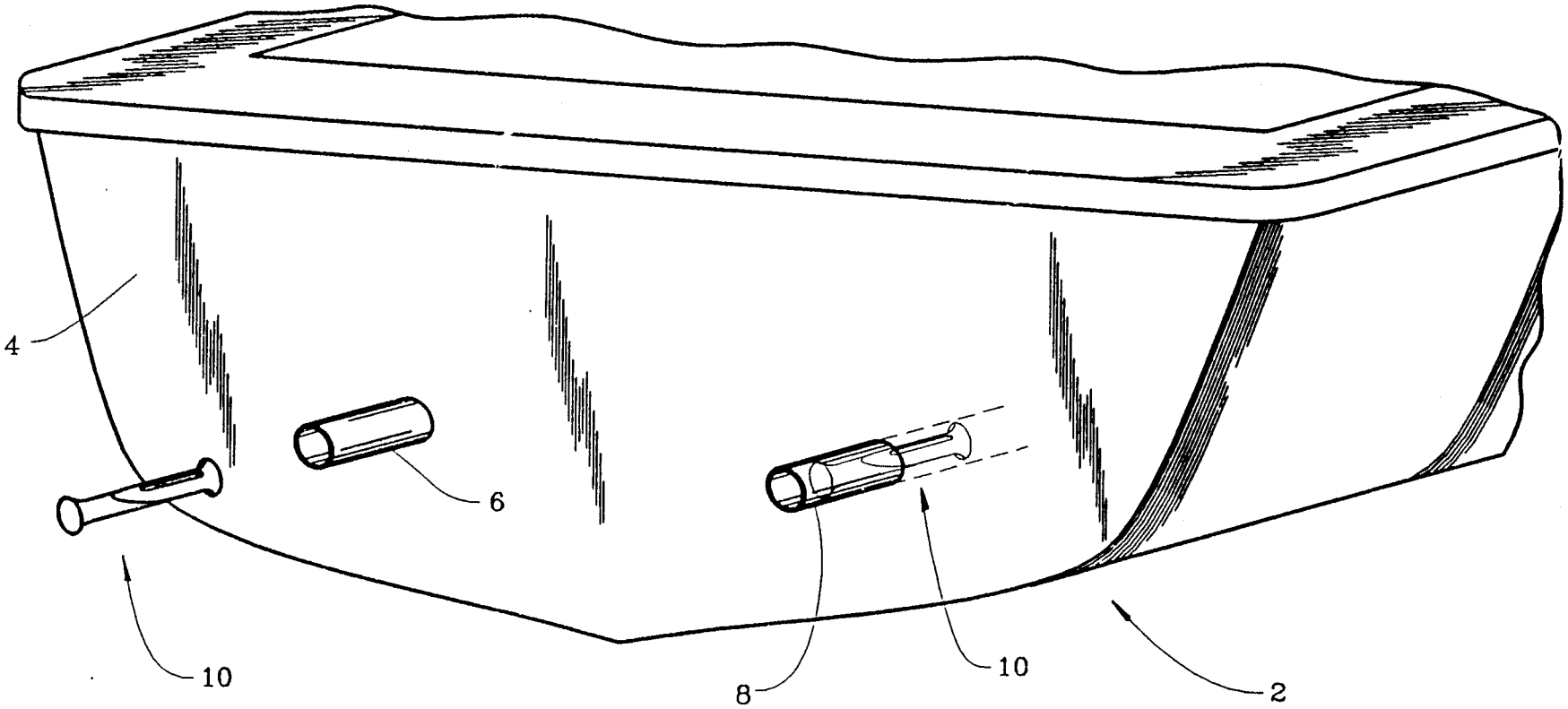
FIG. 1 is a perspective view of a boat transom illustrating placement of the instant invention.
Figure 2:
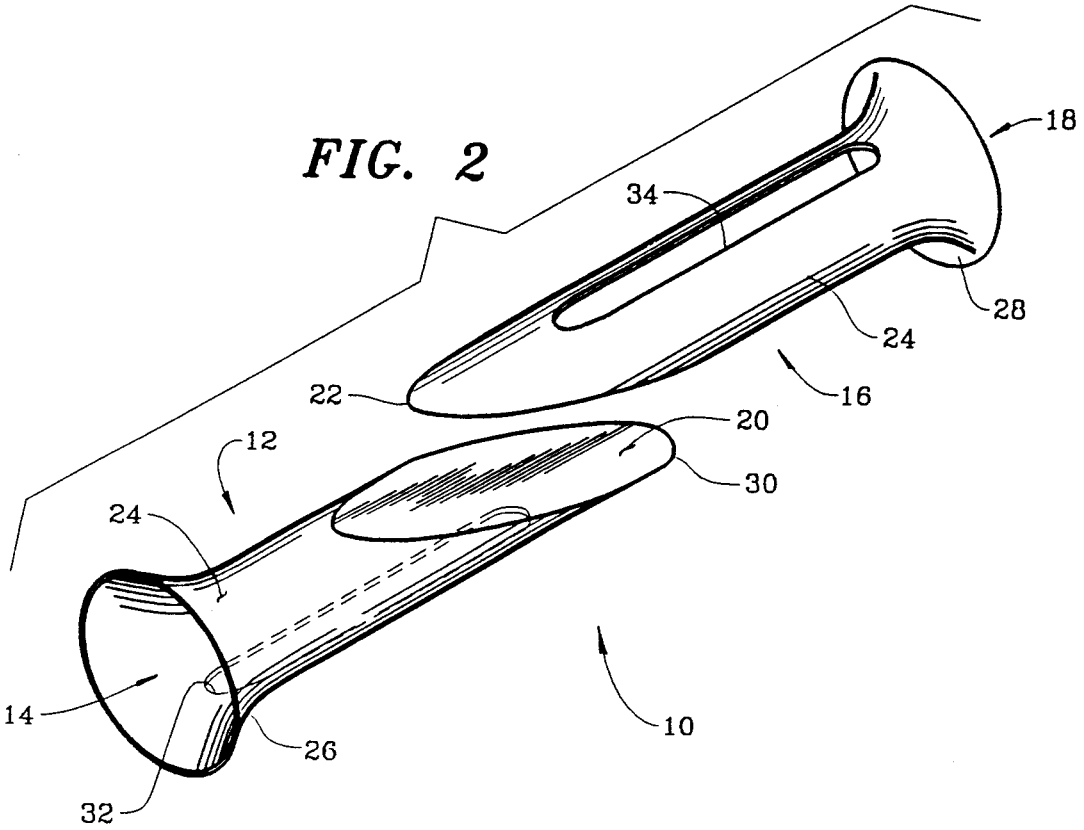
FIG. 2 is a perspective view of the insertion assembly of the instant invention.

FIG. 1 illustrates a boat 2 having a transom stern wall 4 with exhaust pipes 6 and 8 protruding through the stern wall 4. The insertion muffler 10 of the instant invention is shown positioned within exhaust pipe 8 and readied for placement within exhaust pipe 6.

Figure 3:
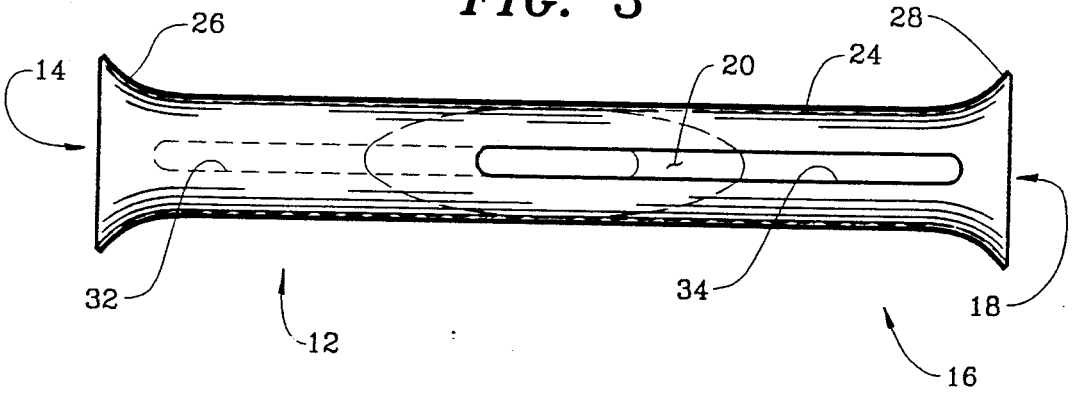
FIG. 3 is a isometric top view of the insertion assembly.

With reference to FIGS. 1 and 3, there is depicted the inner housing 10 of the improved in-line muffler apparatus. The inner housing 10 is generally comprised of an inlet chamber 12, inlet aperture 14, outlet chamber 16, outlet aperture 18, and planar baffle 20. Chambers 12 and 16 may be fabricated from, for example but not by way of limitation, a section of substantially cylindrical conduit made of steel or fire retardant fiberglass or fiberglass reinforced plastic (FRP) or arimid fibers or carbon fibers. In order to facilitate manufacture, chambers 12 and 16 are formed from a single piece of material angularly separated along edge 22 for attachment of baffle 20 as described in detail below.

Inlet chamber 12 is defined by side wall 24 having a nominal thickness with a first or inlet end segment 26 formed by flaring side wall 24 near inlet 14. Alternatively, end segment 26 can be formed from a separate component and sealingly attached to the side wall 24 by bonding, welding, or the like. Baffle 20 is an impervious planar member constructed of material compatible with the chamber and is attached to edge 22 by bonding, welding, or the like.

Outlet chamber 16 is defined by side wall 24 having a nominal thickness with a second or outlet segment end 28 formed by flaring side wall 24 near outlet 18. Alternatively, end spacer 28 can be formed from a separate component and sealingly attached to the side wall 24 by bonding, welding, or the like. Baffle 20, constructed of material compatible with the chamber, is attached to cut 22 by bonding, welding, or the like, preferably at an angle between 25 and 65 degrees.

Baffle 20 may, in the alternative, be slid into the desired position within inner housing 10 and secured therein at the appropriate orientation by welding or the like.

It should be obvious that inlet chamber 12 and outlet chamber 16 form a mirror image one another. In a preferred embodiment, chambers 12 and 16 are joined together at previously shared edge 22 with planar baffle 20 separating the pipe into an inlet chamber 12 and outlet chamber 16. Accordingly, a single planar baffle may be used when housing 12 and 16 are rejoined.

Planar baffle 20 divides inner housing 10 into a first or inlet chamber 12 and a second, or outlet chamber 16. Inlet chamber 12 defines at least one elongated aperture 32 therein adapted to fluidly communicate the interior of inlet chamber 12 with the peripheral, or silencing, volume defined by inner housing 10, end segments 26, 28, and the interior surface of outer housing 40. Outlet chamber 16 defines a second elongated aperture 34 therein, which is preferably disposed on the opposite side of inner housing 10 from first aperture 32.

Figure 4:
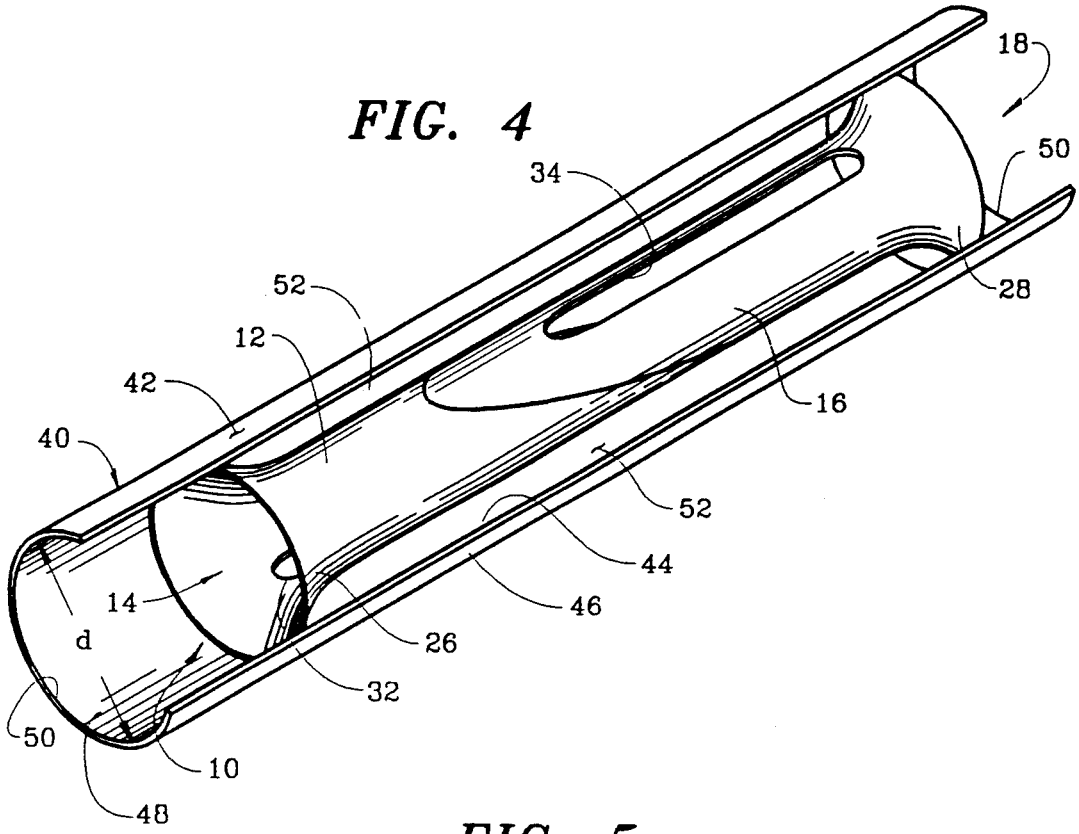
FIG. 4 is a cross sectional view of a housing with a plan view of the insertion assembly.

Now referring to FIG. 4, a muffler assembly is depicted wherein elongated tubular outer housing 40 is shown having side wall 42 of nominal thickness, and having an inner surface 44 and an outer surface 46. As mentioned earlier, the housing 40 can be an existing pipe in an exhaust system, such as 6 or 8 as shown in FIG. 1, or alternatively, the housing 40 can be made part of the muffler assembly. The inner surface 44 defines an interior chamber of a first diameter d. Inlet inner housing 10 is shown slidably inserted into outer housing 40 wherein inlet end segment 26 is sealed to inner surface 44 and outlet end segment 28 sealed to inner surface 44 in which the inlet end segment 26 and the outlet end segment 28 have a diameter substantially equal to that of the first diameter of the outer housing inner surface 44. It should be noted that inlet 48 and outlet 50 of housing 40 are or may be made adaptable to most any conventional exhaust piping by coupling to, for example, but not limited to, flanges, U-bolts, or welding. A peripheral or silencing volume 52 is formed between the outer surface of inner housing 10, inner surface 44 of outer housing 40, and flared end segments 26 and 28.

Figure 5:
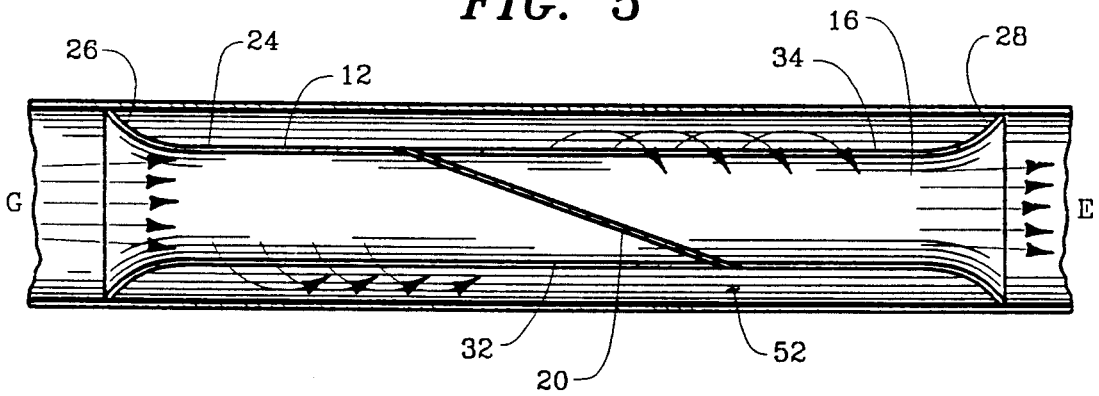
FIG. 5 is a cross sectional side view of the muffler assembly.

FIG. 5 illustrates operation of the muffler for silencing of exhaust gas by directing high velocity exhaust gas, and cooling water injected and mixed therewith, collectively referred to as G, through inlet passageway 14 into inlet chamber 12. As the exhaust gas and cooling water mixture enters the inlet chamber 12 the exhaust will reflect off planar baffle 20 forcing the exhaust through aperture 32 into silencing volume 52. Cooling water that condenses will accumulate along the bottom of silencing volume 52 which aids in heat transfer and noise dissipation. The energy of the escaping exhaust gas through first aperture or passageway 32 will force a portion of the condensed volume of cooling water to vaporize or otherwise be transported upwards and around sidewall 24 where the gas and water may enter outlet chamber 16 through aperture 34 and exit through outlet passageway 18 in the form of exhaust gas flow E.

The angularly disposed planar baffle 20 functions as an acoustical barrier by creating sonic reflections with the inlet chamber 12 and outlet chamber 16 which assists in dissipating the acoustical energy of the exhaust, and as a surge protector by impeding the reverse flow of water into the engine exhaust manifold by functioning as a ramping surface or break between chambers 12 and 16, respectively. Accordingly, less external exhaust piping is required, resulting in lower overall exhaust system back pressure and, thus, higher engine efficiency.

Figure 6:
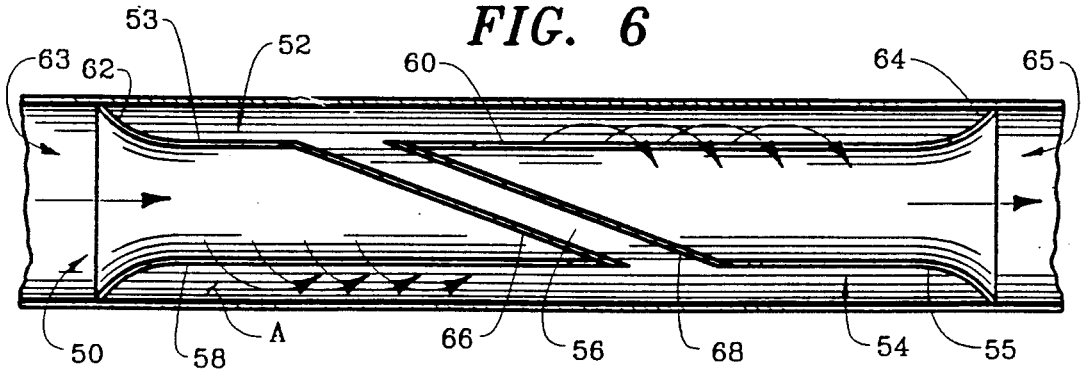
FIG. 6 is a cross-sectional side elevational view of a second embodiment of my muffler.
Figure 7:
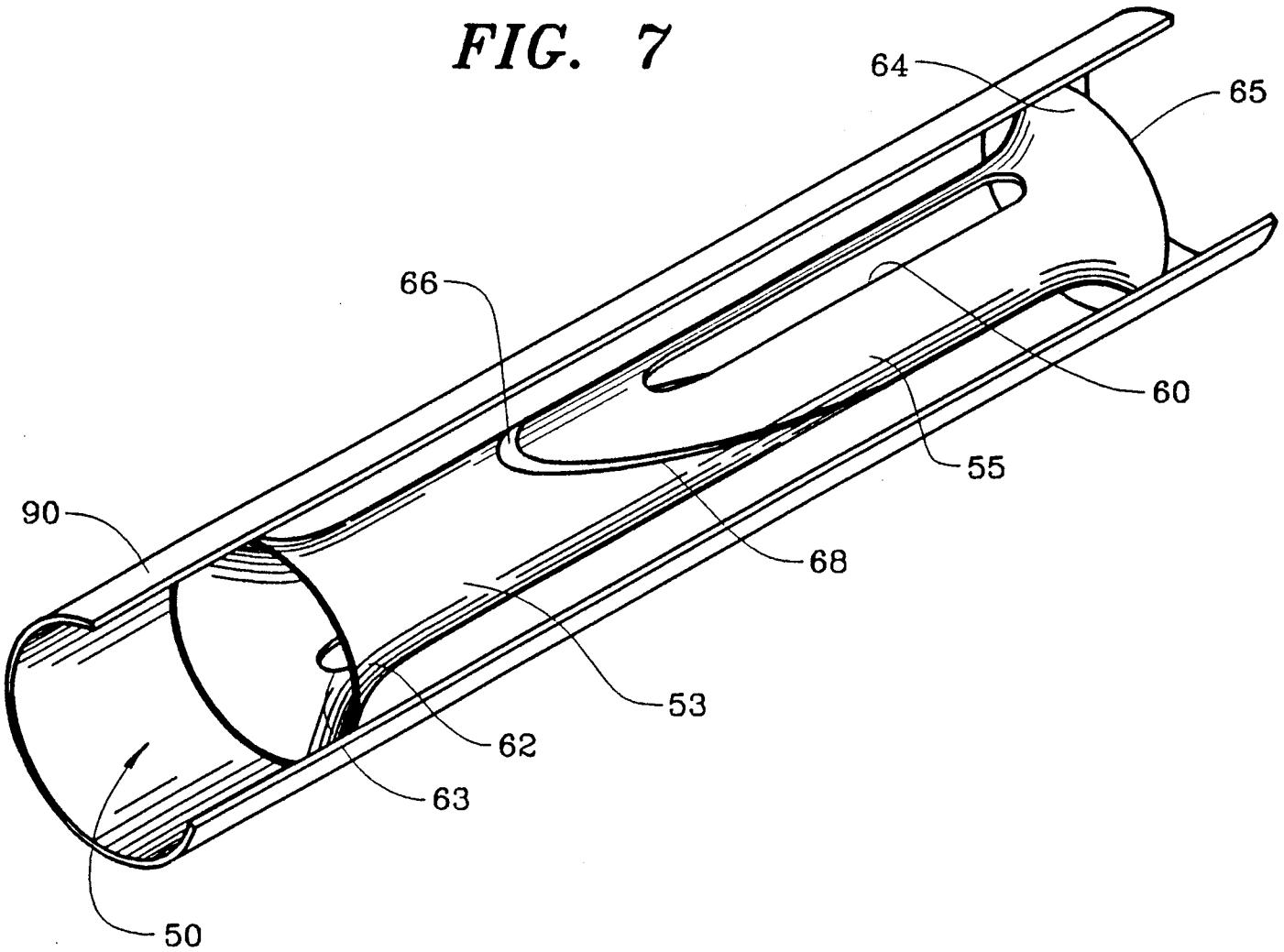
FIG. 7 is a perspective partial cut-away view shown in the second embodiment of my invention.

FIGS. 6 and 7 show a second embodiment of my invention wherein inner housing 50 is divided into separate, discreet, elements. Inlet chamber 52 is comprised of a generally cylindrical hollow conduit wall section 53 and defines a generally elongated aperture 58 therein to fluidly communicate the interior of inlet chamber 52 with peripheral, or silencing, volume A. Side wall 53 is integrally connected to first, or inlet, end segment 62, which defines an inlet aperture 63 to fluidly communicate a source of exhaust gas flow with inner housing 50. Outlet chamber 54 is comprised of a generally cylindrical hollow conduit side wall 55 which defines an elongated flow aperture 60 therein which fluidly communicates volume A with the interior of outlet chamber 54. Side wall 55 is integrally connected to second, or outlet, end segment 64, which in turn defines an outlet aperture 65 therein to fluidly communicate outlet chamber 54 with the remainder of the exhaust system.

In this second embodiment inlet chamber 52 is truncated by an angularly disposed planar baffle 66 which is sealingly connected to side wall 53. Likewise, outlet chamber 54 is truncated by an angularly disposed planar baffle 68, which is sealingly connected to side wall 55, defining a volume 56 with first baffle 66. Baffle 68 acts to reverse surge water entering outlet chamber 54 by acting as a ramp, causing gravity to return such surge water out of chamber 54 through aperture 65. In this way, surge water is precluded from entering inlet chamber 52, and thereafter entering the engine (not shown).

It should be noted throughout this disclosure that baffles 20, 66 and 68 may be planar, convex, concave, or any other configuration, so long as surge water is redirected and further so long as the inlet and outlet chambers of the inner housing are sealed off from the silencing volume excepting the flow aperture defined by the inlet and outlet chamber side walls.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An in-line muffler for a marine engine, comprising:

a tubular housing means having a side wall of nominal thickness formed by an inner surface and an outer surface, said inner surface defining an interior chamber with an inlet means and an outlet means; an impervious planar means for baffling terminating in an outer periphery edge and having at least two side surfaces adapted to sealably fit within said interior chamber of said housing means sealably attached at an angle thereto such that said interior chamber of said housing means is partitioned into an inlet and outlet chamber; at least one aperture disposed within the side wall of said inlet chamber of said housing means diametrically opposed to one side surface of said planar means for baffling; and at least one aperture disposed within the side wall of said outlet chamber of said housing means diametrically opposed to a second side surface of said planar means for baffling;

wherein said housing slidably fits and aid inlet and outlet means sealably attachable within a conventional exhaust pipe forming a silencing volume between an inner surface of the exhaust pipe and an outer surface of said housing means, whereby said inlet means of said housing means having a diameter substantially equal to that of said inner surface of said exhaust pipe permitting the influx of exhaust gas and cooling water into said inlet chamber of said housing means providing an area for reduced velocity to attenuate exhaust noise before the exhaust gas is forced through said aperture of said inlet chamber into the silencing volume and into said aperture of said outlet chamber, said gas and water exiting through said outlet means having a diameter substantially equal to that of said inner surface of said exhaust pipe, said angularly disposed impervious means for baffling defining a trap area for preventing the reverse flow of water into the engine.

2. The muffler recited in claim 1, wherein said inlet means is disposed collinearly with said outlet means.

3. The muffler recited in claim 1, wherein said baffle is attached at an angle between 5 and 90 degrees.

4. The muffler recited in claim 1, wherein said housing is fabricated from the group consisting of fiberglass reinforced plastic (FRP) or arimid fibers or carbon fibers.

5. The muffler recited in claim 1, wherein said housing is fabricated from corrosion resistent metal.

6. The muffler recited in claim 1, wherein said inlet chamber and said outlet chamber are manufactured separately.

7. The muffler recited in claim 1, wherein said inlet chamber is a mirror image of said outlet chamber.

8. The muffler recited in claim 1, wherein said an impervious means for baffling defines an elliptical section when viewed normal to said top of said housing.

9. The muffler recited in claim 1, wherein said inlet means and said outlet means is operatively associated with said exhaust pipe by use of an O-ring.

10. The muffler recited in claim 1, wherein said inlet means and said outlet means is operatively associated with said exhaust pipe by permanent attachment thereto.

11. An in-line muffler for a marine engine, comprising:

a first elongated tubular housing means having a side wall of nominal thickness formed by an inner surface and an outer surface, the inner surface defining an interior chamber of a first diameter with an inlet and an outlet; a second tubular housing means having a side wall of nominal thickness formed by an inner surface and an outer surface, said second tubular housing's inner surface defining an interior chamber of a second diameter with an inlet means and an outlet means, said second housing slidably fit and said inlet and outlet means sealably attached within sadi interior chamber of said first housing means forming a silencing volume between the inner surface of said first housing means and an outer surface of said second housing means and said inlet means and sadi outlet means having a diameter substantially equal to that of the inner surface of said first tubular housing; an impervious planar means for baffling terminating in an outer periphery edge and having at least two side surfaces adapted to slidably fit within said interior chamber of said second housing means sealably attached at an angle thereto such that said interior chamber of said second housing means is partitioned into an inlet and outlet chamber; at least one aperture disposed within the side wall of said inlet chamber of said second housing means diametrically opposed to one side of said planar means for baffling; and at least one aperture disposed within the side wall of said outlet chamber of said second housing means diametrically opposed to a second side surface of said planar means for baffling; wherein said inlet means of said first housing means is operatively associated with said inlet means of said second housing means permitting the influx of exhaust gas and cooling water into said inlet chamber of said second housing means providing an area for reduced velocity to attenuate exhaust noise exhaust is forced through said aperture of sadi inlet chamber into said silencing volume and into said outlet chamber of said second housing means through said aperture, wherein said exhaust and water may exit through said outlet means of said first housing means which is operatively associated with the outlet means of said second housing means, said angularly disposed imperious means for baffling defining a trap area for preventing the reverse flow of water into the engine.

* * * * *